US005749453A

United States Patent [19]

Doornekamp et al.

[11] Patent Number: 5,749,453

[45] Date of Patent: May 12, 1998

[54] APPARATUS FOR ORIENTING EGGS ON A SECOND CONVEYOR WITH THEIR POINTS TO ONE SIDE

[75] Inventors: Martin Doornekamp, Nijker; Willem Van Veldhuisen; Willem Marius De Greef, both of Lunteren, all of Netherlands

[73] Assignee: FPS Food Processing Systems B.V., Netherlands

[21] Appl. No.: 614,842

[22] Filed: Mar. 8, 1996

[30] Foreign Application Priority Data

Mar. 13, 1995 [NL] Netherlands ..... 9500496

[51] Int. Cl.[6] ..... B65G 47/22

[52] U.S. Cl. ..... 198/400; 198/377; 198/959; 53/244; 414/783

[58] Field of Search ..... 177/52, 54; 198/400, 198/377, 959; 414/754, 783, 21; 53/235, 244

[56] References Cited

U.S. PATENT DOCUMENTS

| | | | |
|---|---|---|---|
| 2,643,778 | 6/1953 | Socke | 198/377 |
| 3,370,692 | 2/1968 | Mosterd . | |
| 3,985,223 | 10/1976 | Forcella et al. | 198/377 |
| 4,522,293 | 6/1985 | van Kattenbroek | 198/377 |
| 5,176,243 | 1/1993 | Temming et al. | 198/400 |

FOREIGN PATENT DOCUMENTS

| | | |
|---|---|---|
| 132757 | 6/1971 | Netherlands . |
| 1029661 | 5/1966 | United Kingdom . |
| 1081508 | 8/1967 | United Kingdom . |

*Primary Examiner*—Frank E. Werner
*Attorney, Agent, or Firm*—Larson & Taylor

[57] ABSTRACT

An apparatus for transferring eggs from a first roller conveyor (1) to a second conveyor (2), with an orienting operation taking place during the transfer, so that the eggs on the second conveyor (2) are all oriented with their points to one side, the rollers (3) of the first roller conveyor being substantially hourglass-shaped and comprising a roller center part (3a) which is substantially cylindrical, the apparatus comprising pre-orienting devices (4) for bringing the eggs on the first roller conveyor (1) into a pre-oriented position (A), the apparatus being provided with a transfer conveyor (5) having grippers (6) which are each adapted to pick up an egg from the pre-oriented position (A), the grippers (6) being adapted to bring the eggs into an aligned position (C) and to transfer the eggs from the aligned position (C) to the second conveyor (2).

11 Claims, 7 Drawing Sheets

APPARATUS FOR ORIENTING EGGS ON A SECOND CONVEYOR WITH THEIR POINTS TO ONE SIDE

FIELD OF THE INVENTION

The invention relates to an apparatus for transferring eggs from a first roller conveyor to a second conveyor, with a orienting operation taking place during the transfer so that the eggs on the second conveyor are all oriented with their points to one side, the rollers of the first roller conveyor being substantially hourglass-shaped and comprising a roller center part which is substantially cylindrical, the apparatus comprising pre-orienting means for bringing the eggs on the first roller conveyor into a pre-oriented position.

BACKGROUND OF THE INVENTION

Such an apparatus is known from NL-A-0,132,757 or, for instance, EP-A-0,512,585. The most important drawback of the known apparatuses is formed by the relatively limited processing capacity thereof. The known apparatuses have a processing capacity of approximately 6,500 eggs per hour per conveying track. This capacity is limited inter alia because during the transfer from the first roller conveyor to the second conveyor, the eggs make a falling motion ending on a roller of the second conveyor which is in both cases also constructed as a roller conveyor. Because this falling motion must not take place in an uncontrolled manner—as this would cause breakage to the egg at the end of the falling motion—, the falling motion is braked. This results in a deceleration of the processing rate and, accordingly, in the above-mentioned relatively low processing capacity.

Another drawback of the known apparatuses is that the first conveyor and the second conveyor are located at different levels, because the egg should make a falling motion between these two conveyors. Hence, the installation space, in particular the installation height, required for the known apparatus is greater than is desired in some cases.

Still another drawback of the known apparatuses is that during the transfer from the first roller conveyor to the second conveyor, the performance of additional operations to the eggs, such as for instance weighing or blood detection, is not possible. Moreover, during the transfer from the first roller conveyor to the second conveyor, it is not possible to discharge eggs from the conveying track on the basis of some selecting criterion, such as for instance weight.

SUMMARY OF THE INVENTION

The object of the invention is to provide an apparatus without the above-described drawbacks and having an extremely high capacity.

To this end, the apparatus for transferring eggs from a first roller conveyor to a second conveyor, with an orientating operation taking place during the transfer; is characterized in that it comprises a transfer conveyor having grippers which are each adapted to pick up an egg from the pre-oriented position, the grippers being adapted to bring the eggs into an aligned position and to transfer the eggs from the aligned position to the second conveyor.

With a thus designed apparatus for transferring and orienting eggs, it is provided that after the pre-orienting operation, the further aligning operations are performed by the grippers in a positive manner. As these further aligning operations are performed in a positive manner, this can take place at a high speed, which has a favorable effect on the processing capacity of the apparatus. With the apparatus according to the invention, a capacity of 17,000 per hour per conveying track can be achieved without any problems. Hence, the processing capacity is about two and a half times as great as the processing capacity of the known apparatuses.

Because the transfer operation takes place entirely in a positive manner and the egg does not make an uncontrolled motion, such as for instance a falling motion, the risk of breakage occurring during the transfer and the orienting operation is minimized.

BRIEF DESCRIPTION OF THE DRAWINGS

Further elaborations of the invention are described in the detailed description and will be specified on the basis of two exemplary embodiments, with reference to the accompanying drawings, wherein.

DESCRIPTION OF THE PREFERRED EMBODIMENT

Figure 1:
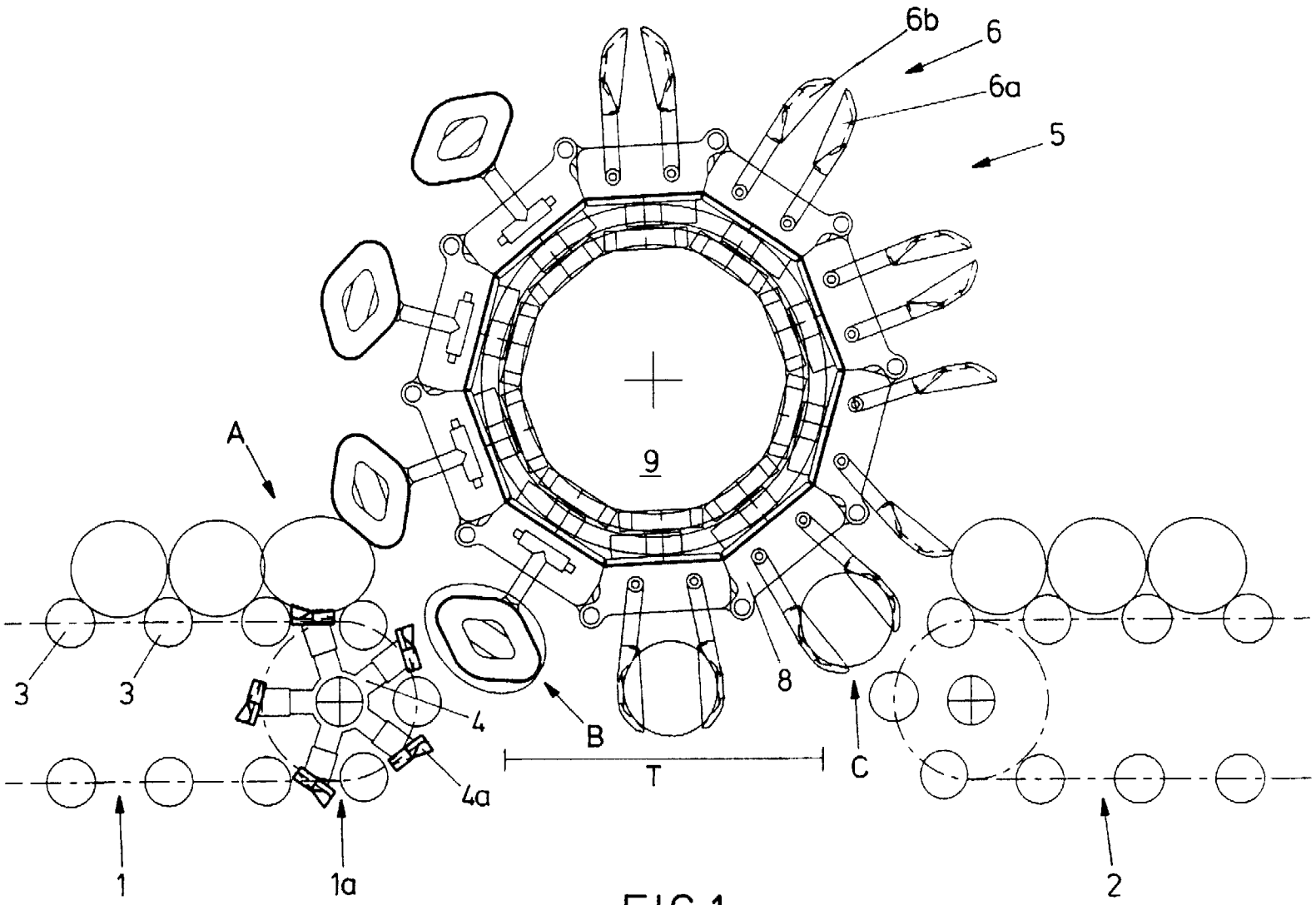
FIG. 1 is a side elevation of a first exemplary embodiment.
Figure 2:
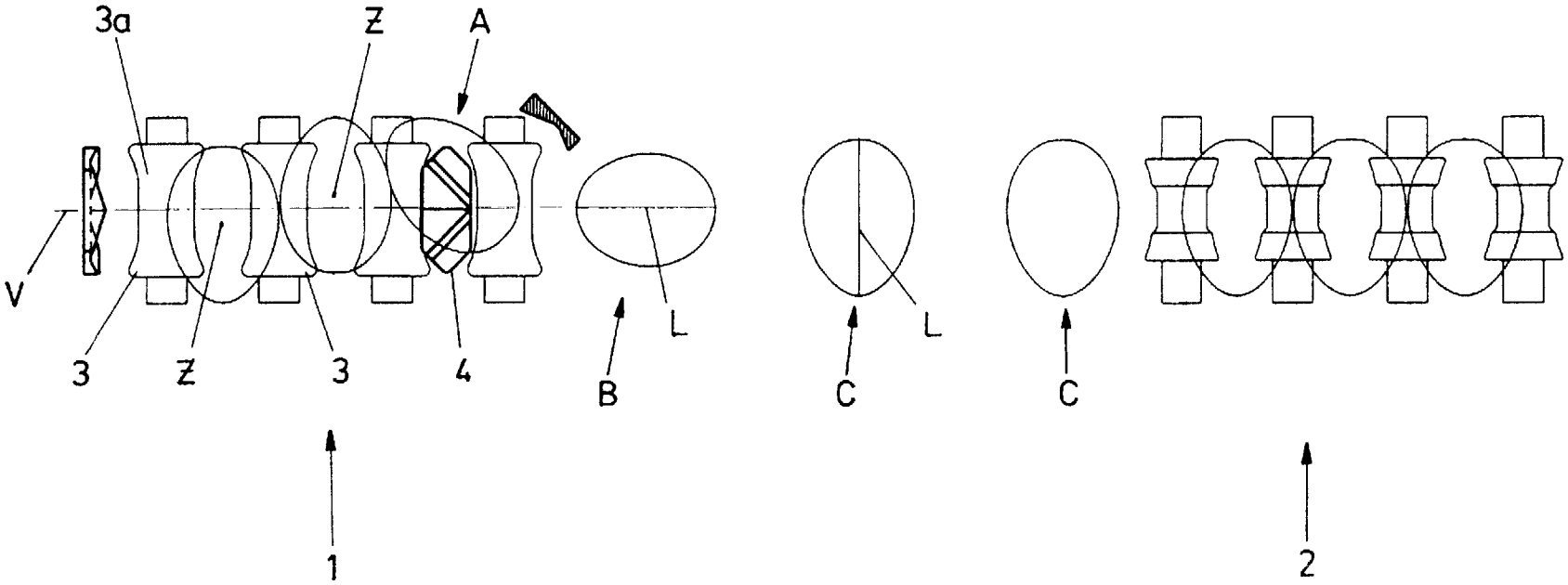
FIG. 2 is a top plan view of the exemplary embodiment shown in FIG. 1, with the transfer conveyor left out.
Figure 4:
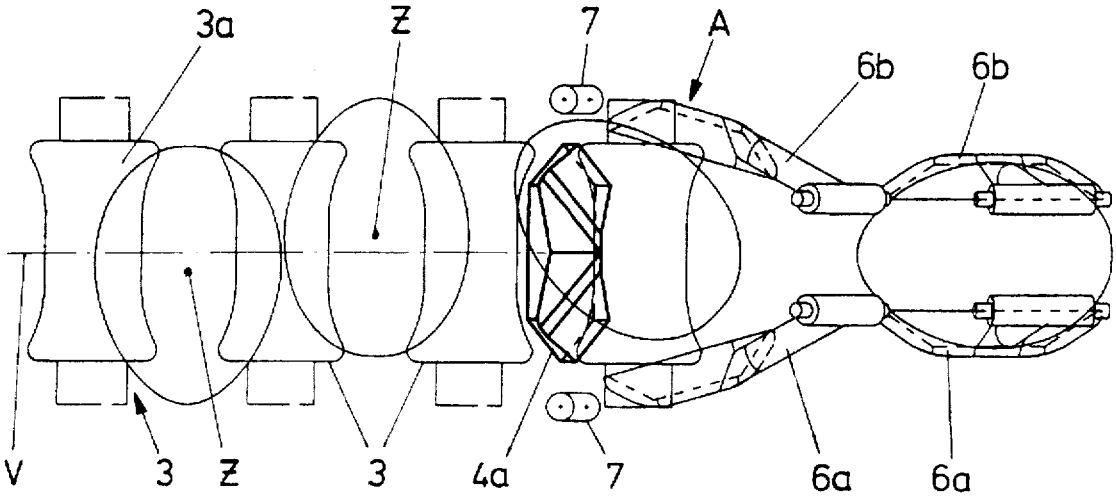
FIG. 4 is a partial top plan view of the exemplary embodiment shown in FIG. 3.

All exemplary embodiments shown concern apparatuses for transferring eggs from a first roller conveyor 1 to a second conveyor 2, with an orienting operation taking place during the transfer, so that the eggs on the second conveyor 2 are all oriented with their points to one side. The rollers 3 of the first roller conveyor 1 are substantially hourglass-shaped and comprise a roller center part 3*a* which is substantially cylindrical. The rollers 3 of the first roller conveyor 1 rotate during their travel. Because an egg located between two rotating cylindrical rollers 3 will move in the direction of the point of the egg relative to the rollers 3, the eggs on the first roller conveyor 1 will shift with their points towards the outer side of the roller conveyor 1, owing to the presence of the substantially cylindrical roller center part 3*a*. This phenomenon is clearly shown in FIGS. 2 and 4. The position of the center of gravity Z of the egg relative to the plane V intersecting the hourglass-shaped rollers 3 perpendicularly through the center depends on the position of the egg, in particular the side to which the point of the egg is oriented. The apparatus further comprises pre-orienting means 4, adapted to bring the eggs on the first roller conveyor 1 into a pre-oriented position A.

All exemplary embodiments shown in the Figures are characterized in that they comprise a transfer conveyor 5 having grippers 6 which are each adapted to pick up an egg from the pre-oriented position A. The grippers 6 are adapted to bring the eggs into an aligned position C and to transfer the eggs from the aligned position C to the second conveyor 2.

Figure 5:
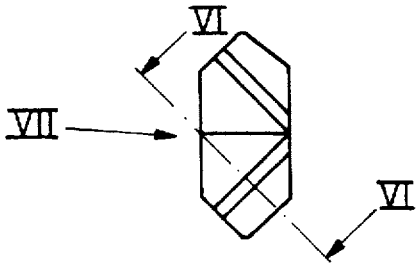
FIG. 5 is a top plan view of a lifting element of the return wheel of the first roller conveyor.
Figure 6:
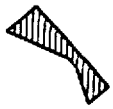
FIG. 6 shows a line VI—VI of FIG. 5.
Figure 7:
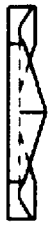
FIG. 7 is a side elevation of the lifting element, viewed in the direction of the arrow VII of FIG. 5.

In the exemplary embodiments shown, the pre-orienting means 4 are designed as a return wheel 4 having saddle-shaped lifting elements 4*a*, shown in detail in FIGS. 5–7. The lifting elements 4*a* are adapted to move in each case between two successive rollers 3 of the conveyor 1 at the discharge end 1*a* of the first roller conveyor 1, while lifting an egg located between the two successive rollers 3. The saddle-shaped lifting elements 4*a* are designed so that the eggs, when being lifted by a lifting element 4*a*, are always rotated with the same end in the conveying direction of the first roller conveyor 1 and brought into the pre-oriented position A. The saddle-shaped section of the lifting element 4*a*, clearly shown in FIG. 7, effects, depending on the position of the center of gravity Z of the egg relative to the highest point of the saddle-shaped lifting element 4*a*, a rotation of the egg such that the butt end of the egg is turned in the conveying direction of the first conveyor 1.

Figure 3:
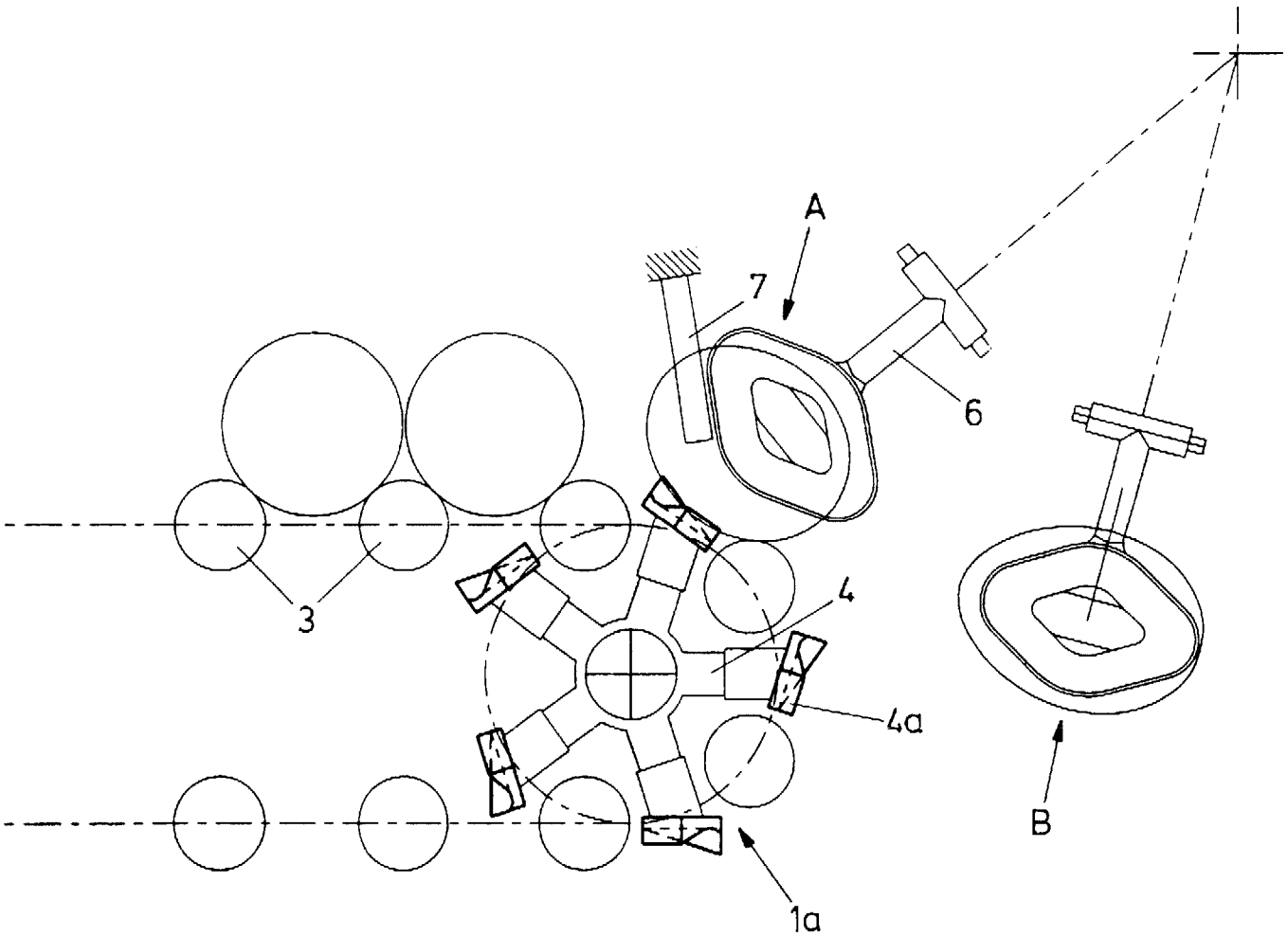
FIG. 3 is a partial side elevation of an exemplary embodiment having orienting pins.

In some cases, it may occur that the lifting element 4*a* does not bring the egg to be oriented into the pre-oriented position A completely. In order to bring the egg as yet into the pre-oriented position A in such cases, in accordance with a further elaboration of the invention, shown in FIGS. 3 and 4, the apparatus can be provided with two orienting pins 7 arranged adjacent the return wheel 4 on both sides of the first roller conveyor 1. The orienting pins 7 are designed and positioned so that eggs which are not yet completely in the pre-oriented position A, are brought into the pre-oriented position A by the orienting pins 7.

Preferably, each gripper 6 of the transfer conveyor 5 comprises two gripper parts 6*a*, 6*b*, which, when an egg is being picked up, bring the egg from the pre-oriented position A into an intermediate position B through closure of the gripper parts 6*a*, 6*b*, in which intermediate position B the longitudinal axis L of the egg lies in a plane V intersecting the axes of rotation of the rollers 3 of the first roller conveyor 1 perpendicularly through the center. At the moment when the eggs are located in a gripper 6, they all have the same orientation and can optionally be brought from this intermediate position B into an aligned position C. For instance, the aligned position C may be displaced 90° relative to the intermediate position B.

Figure 8:
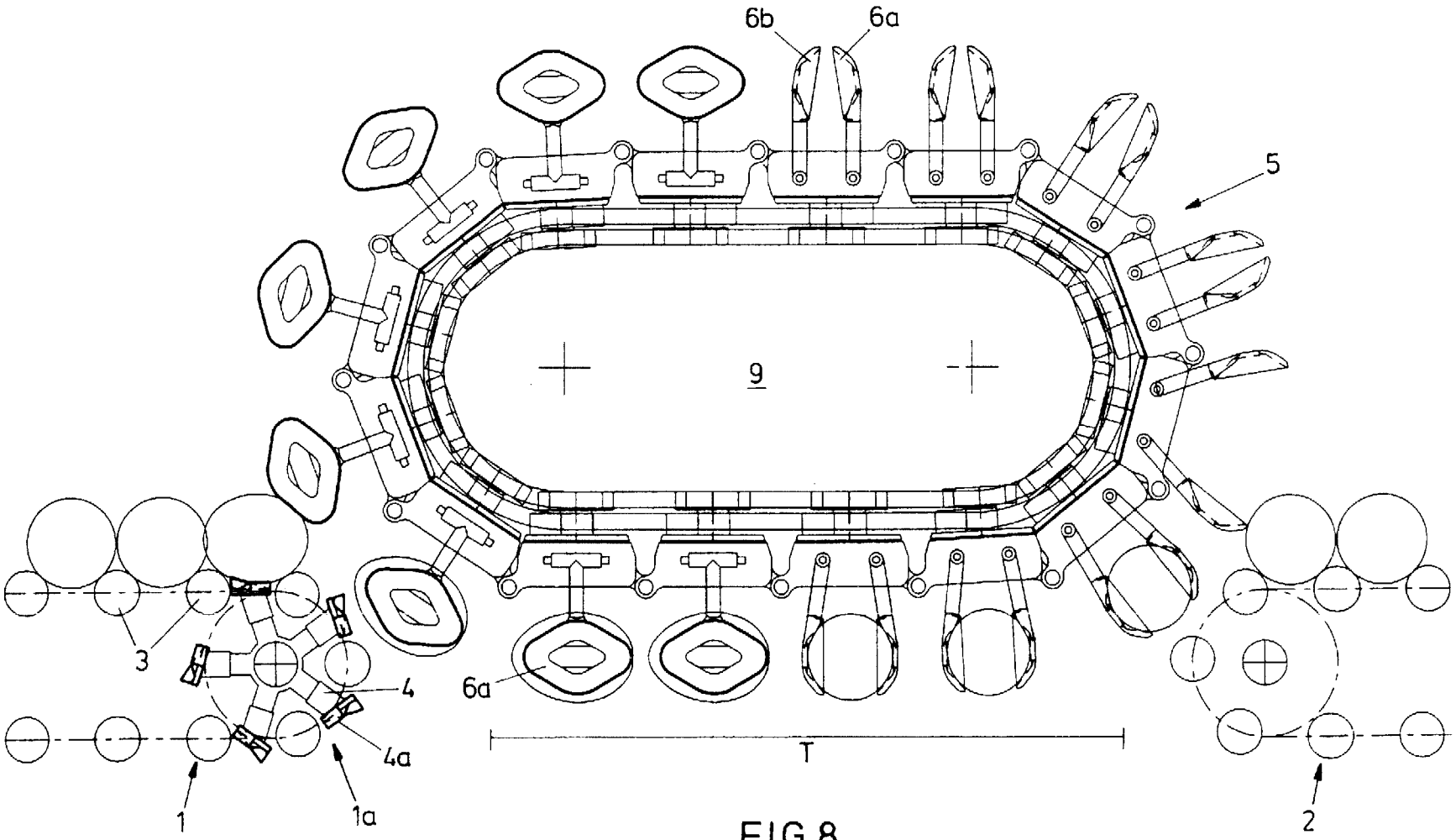
FIG. 8 is a side elevation of a second exemplary embodiment.
Figure 9:
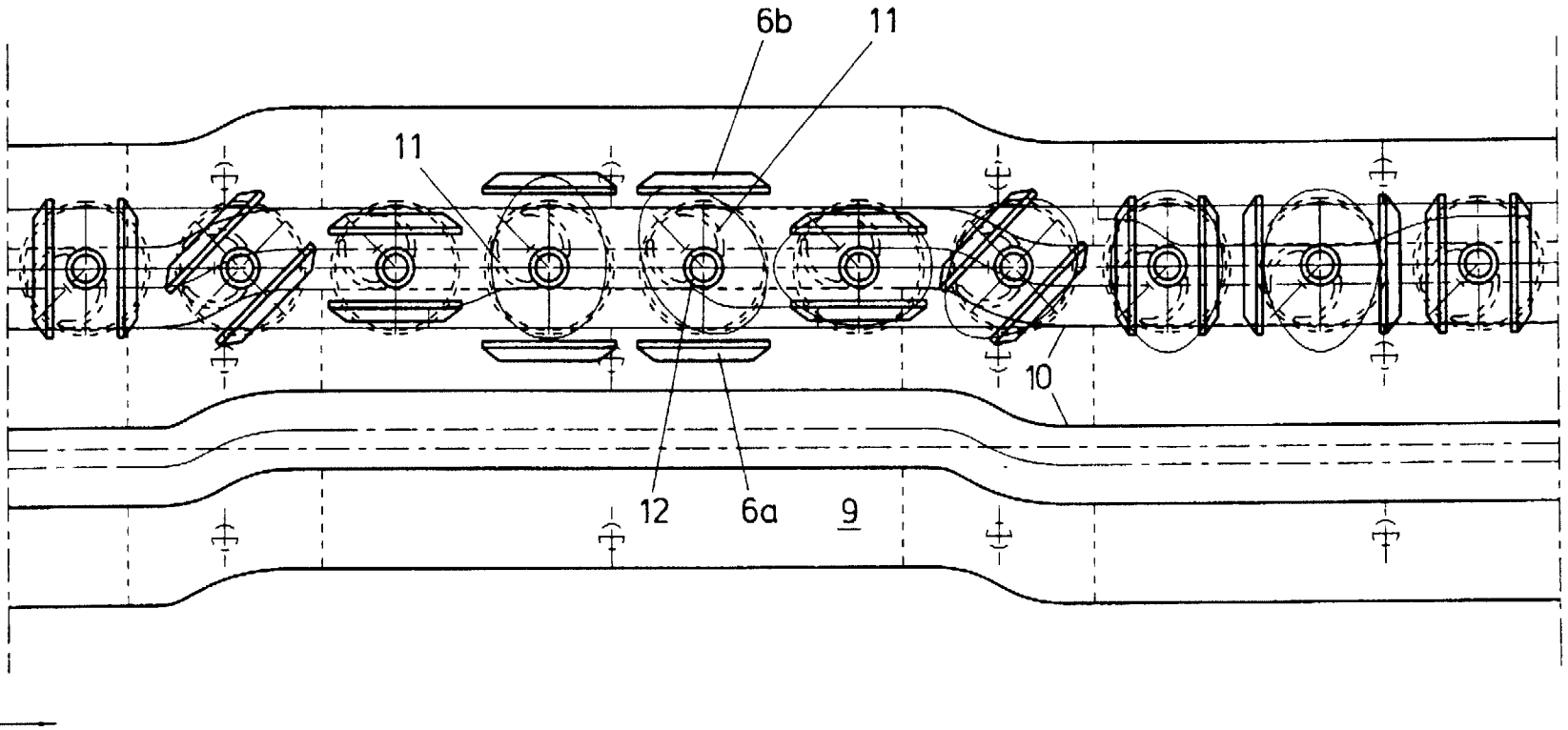
FIG. 9 is a developed view of the circumference of the transfer conveyor.

For this purpose, in accordance with the invention, the grippers 6 may be arranged for rotation through an angle of at least 90°, enabling the eggs to be brought from the intermediate position B into the aligned position C. In the exemplary embodiments shown, the grippers 6 are connected to an endless chain 8 which is guided around a stationary bush or drum 9 having a cam track 10. Each gripper 6 comprises a cam 11 which cooperates with the cam track 10 and by means of which the rotative position of the gripper 6 is controllable. FIG. 9 shows, in a developed view, the bush or drum 9 wherein the gripper 6 is projected in a number of successive positions in one of the cam tracks 10. The cam 11 is eccentrically connected to the rotary shaft 12 of the gripper 6. The rotary shaft 12 of the gripper 6 moves along a straight path, in a developed view, whereas the cam track 10 imposes a curved path on the cam 11, so that when the path is being traversed, the rotative position of the gripper 6 is controlled by the cam track 10. The bush or drum 9 may be of a cylindrical design, but may also be designed in the manner as shown in FIG. 8. Such a box-shaped drum 9 with rounded corners provides a slightly longer transferring-conveying track T between the first roller conveyor 1 and the second conveyor 2. This provides the space for arranging means in this track for performing at least one operation on a passing egg, such as for instance weighing means for weighing a passing egg, or detection means for detecting foul or blood. In this manner, the apparatus may not only serve to orient the eggs with their points to one side, but also to determine specific properties of the passing eggs.

Another possibility which is provided when the transferring-conveying track T has a certain length is that a third discharge conveyor is disposed between the first roller conveyor 1 and the second conveyor 2, which third discharge conveyor will generally extend perpendicularly to the first and the second conveyor 1, 2. To the discharge conveyor, eggs can for instance be delivered which, on the basis of a certain selection criterion, are not considered suitable for further processing or which are to be discharged for other reasons. As is clearly shown in the Figures, in all exemplary embodiments the first conveyor 1 and the second conveyor 2 are in line, which has a favorable effect on the installation height required for the apparatus.

It is understood that the invention is not limited to the exemplary embodiments described, but that various modifications are possible within the framework of the invention.

We claim:

1. An apparatus for transferring eggs from a first moving roller conveyor to a second moving roller conveyor, with an orienting operation taking place during the transfer, so that the eggs on the second conveyor are all oriented with their points to one side, the rollers of the first roller conveyor being substantially hourglass-shaped and comprising a roller center part which is substantially cylindrical, the apparatus comprising:

a pre-orienting means located between two successive rollers of said first roller conveyor for bringing each egg into a pre-oriented position at the end of the first roller conveyor; and a moving transfer conveyor having a gripper means for picking up the eggs from their respective pre-oriented positions, bringing the eggs into a different aligned position and transferring the eggs from the different aligned position to the second conveyor.

2. An apparatus according to claim 1, wherein the pre-orienting means comprises a return wheel comprising saddle-shaped lifting elements adapted to move between two successive rollers of the conveyor at the discharge end of the first roller conveyor while lifting an egg located between the two successive rollers; and wherein the saddle-shaped lifting elements always rotate the eggs with the same end of the eggs in the conveying direction of the first roller conveyor and bring each egg into one of said pre-oriented positions.

3. An apparatus according to claim 1, wherein orienting pins are provided on both sides of the first roller conveyor, adjacent a return wheel at the discharge end, said orienting pins being positioned so that the eggs which are not yet completely in one of said pre-oriented positions are brought into a pre-oriented position.

4. An apparatus according to claim 1, wherein each gripper means comprises two gripper parts, which, when an egg is being picked up, bring the egg from one of said pre-oriented positions into an intermediate position through closure of the gripper parts, in the intermediate position the longitudinal axis of the egg lies in a plane intersecting the axes of rotation of the rollers of the first conveyor perpendicularly through the center.

5. An apparatus according to claim 4, wherein the gripper means are arranged for rotation at least through 90E, enabling the eggs to be brought from the intermediate position into the aligned position.

6. An apparatus according to claim 5, wherein the gripper means are connected to an endless chain guided around a stationary bush or drum provided with a cam track, each gripper means comprising a cam which cooperates with the cam track and by means of which the rotative position of the gripper means is controllable.

7. An apparatus according to claim 1, wherein the first conveyor and the second conveyor are in line.

8. An apparatus according to claim 1, wherein the transfer conveyor includes a means for performing at least one operation on a passing egg.

9. An apparatus according to claim 8, wherein the operation comprises weighing the egg.

10. An apparatus according to claim 8, wherein the operation comprises detecting foul or blood.

11. An apparatus according to claim 1, further including a third discharge conveyor on which eggs can be delivered by the transfer conveyor on the basis of a predetermined selection criterion.

* * * * *